United States Patent [19]

Mushrush et al.

[11] 4,102,504

[45] Jul. 25, 1978

[54] VIBRATORY HOPPER-FED, FLAIL-TYPE PULVERIZER

[76] Inventors: George W. Mushrush, 12903 Sturbridge Rd., Woodbridge, Va. 22192; Thomas Schlemmer, Roswell Rd., Dellroy, Ohio, 44620

[21] Appl. No.: 727,994

[22] Filed: Sep. 30, 1976

[51] Int. Cl.[2] ..... B02C 13/282

[52] U.S. Cl. ..... 241/186 R; 241/189 R; 241/285 R

[58] Field of Search ..... 241/186 R, 186.4, 189 R, 241/189 A, 191, 239, 285 R, 285 A, 285 B, 286; 310/17

[56] References Cited

U.S. PATENT DOCUMENTS

| | | | |
|---|---|---|---|
| 2,784,914 | 3/1957 | Powers | 241/186 R X |
| 2,809,400 | 10/1957 | Maltenfort | 241/189 R X |
| 2,812,552 | 11/1957 | Horton et al. | 241/186 R X |
| 3,144,213 | 8/1964 | Hedlund | 241/285 R X |
| 3,345,525 | 10/1967 | MacBlane | 310/17 |
| 3,680,797 | 8/1972 | Covey | 241/191 X |
| 3,733,500 | 5/1973 | Mushrush | 310/17 |

*Primary Examiner*—Roy Lake
*Assistant Examiner*—Howard N. Goldberg
*Attorney, Agent, or Firm*—Cushman, Darby & Cushman

[57] ABSTRACT

Granular material to be pulverized is fed from a hopper, preferably with assistance from a vibratory feeder, into the housing of a flail-type pulverizer. The housing includes a wall portion which is adjustable towards and away from the flails, for adjusting the fineness of grinding. Preferably that wall portion is mounted with respect to the remainder of the housing with the interposition of elastomeric bushings. Adjustment may be made by exchanging bushings of one thickness for those of another thickness.

6 Claims, 3 Drawing Figures

VIBRATORY HOPPER-FED, FLAIL-TYPE PULVERIZER

BACKGROUND OF THE INVENTION

Present coinventor Mushrush has previously obtained U.S. Pat. No. 3,733,500, issued May 15, 1973 for an Adjustable Electromagnetic Vibrator. A principal use for such a vibrator, as disclosed therein, is for a storage hopper or bin wall in order to assist with movement of stored material to the outlet of the hopper or bin.

Ruckstuhl, U.S. Pat. No. 3,490,705, issued Jan. 20, 1970 shows a hopper-fed hammermill. There is no apparent way of adjusting the radial distance between the hammers and the screen. Throughput is adjusted by damping at 92 the suction being drawn by the fan 66.

In Fritz, U.S. Pat. No. 1,634,026, issued June 28, 1927, throughput is varied by angularly shifting the screen 10 with respect to the screen 8 to put the openings 9 and 11 into greater or lesser registry.

Frickey, U.S. Pat. No. 1,759,448, issued May 20, 1930, shows a rotary grinder fed by a screw conveyor 63. The grinder housing has adjustments at 53 and 23, but they are disclosed as means to permit disassembly, presumably for cleaning.

SUMMARY OF THE INVENTION

The present invention provides a flail-type pulverizer of simple construction which can be easily adjusted to increase or decrease the particle size of the output thereof. Preferably the pulverizer is fed by a vibratory hopper whose outlet is directly connected to the inlet of the pulverizer.

Granular material to be pulverized is fed from a hopper, preferably with assistance from a vibratory feeder, into the housing of a flail-type pulverizer. The housing includes a wall portion which is adjustable towards and away from the flails, for adjusting the fineness of grinding. Preferably that wall portion is mounted with respect to the remainder of the housing with the interposition of elastomeric bushings. Adjustment be made by exchanging bushings of one thickness for those of another thickness.

The principles of the invention will be further discussed with reference to the drawing wherein a preferred embodiment is shown. The specifics illustrated in the drawing is intended to exemplify, rather than limit, aspects of the invention as defined in the claims.

DETAILED DESCRIPTION OF A PRESENTLY PREFERRED EMBODIMENT OF THE INVENTION

Figure 1:
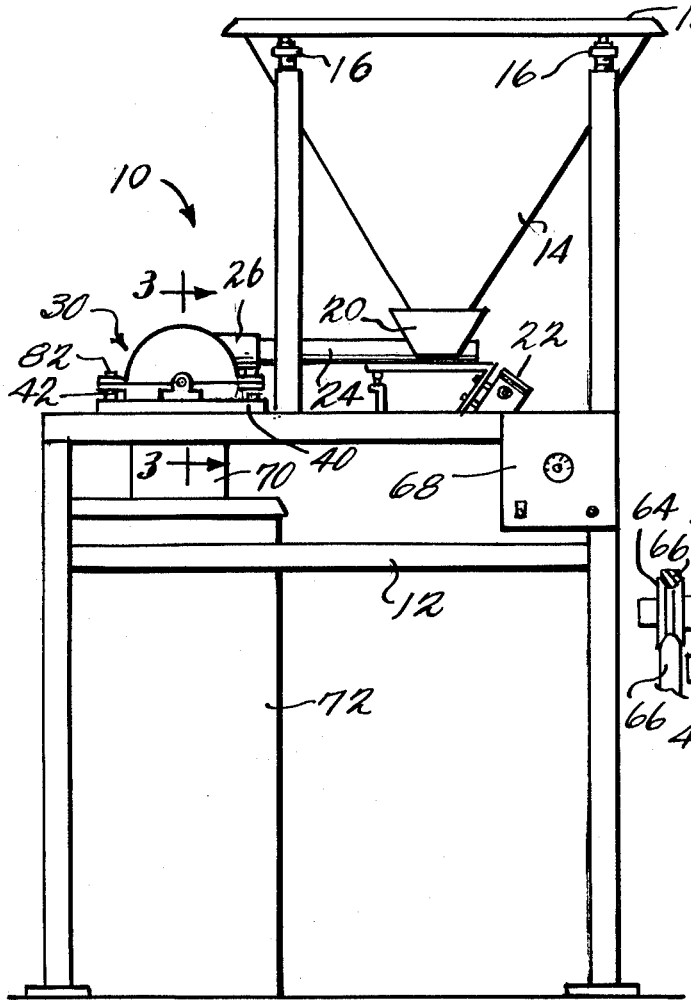
FIG. 1 is a side elevation view of the vibrating hopper-fed, flail-type pulverizer.
Figure 3:
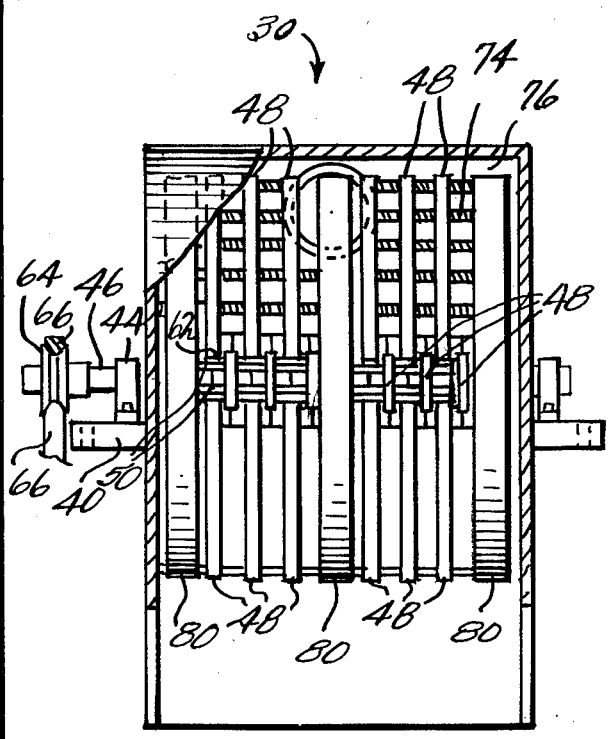
FIG. 3 is a vertical longitudinal sectional view substantially on line 3—3 of FIG. 1.
Figure 2:
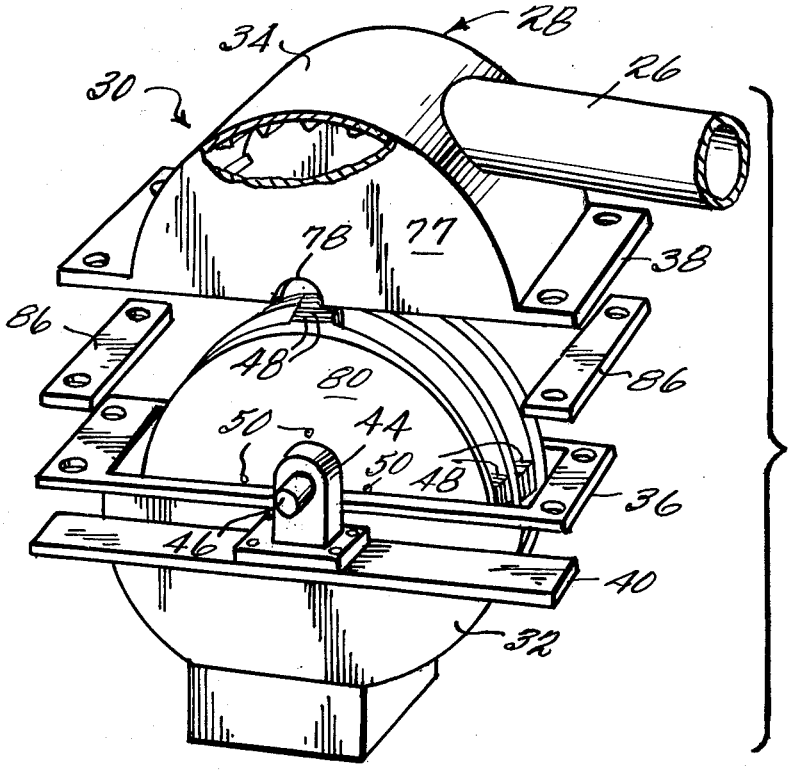
FIG. 2 is an exploded perspective view of the flail-type pulverizer.

In the embodiment shown in the drawing, the vibrating hopper-fed, flail-type pulverizer 10 includes a frame 12. A hopper 14 is mounted on the frame 12 with the aid of elastomeric bushings 16 or equivalent resilient mounts. The inlet end of the hopper 14 is at 18 and its outlet or discharge end is at 20. In the region of the discharge end of the hopper, a vibratory feeder 22 is secured to the hopper. The vibratory feeder may, for instance, be an adjustable electromagnetic vibrator as disclosed in Mushrush, U.S. Pat. No. 3,733,500, issued May 15, 1973, or an equivalent device. In general, a vibratory feeder functions to thump the wall of the hopper near the hopper outlet to cause fluent, particulate material in the hopper to sink toward the discharge end of the hopper and to avoid bridging or clogging the discharge end of the hopper. In addition, the vibrator in connection with the hopper wall tends to function as a vibratory conveyor table, to advance particulate material out through the discharge end of the hopper.

Also as shown, the hopper discharge end 20 is directly connected via a short tubular conduit 24 to the tubular inlet 26 to the housing 28 of a flail-type pulverizer 30.

The housing 28 is shown including a lower, generally semi-cylindrical portion 32 and an upper, semi-cylindrical portion 34. These portions, at their adjacent edges have outwardly directed peripheral flanges 36, 38.

The lower portion 32 is also provided with a further flange 40 by which the pulverizer 30 is bolted to the frame 12, e.g. with bolts 42. The flange 40 also mounts bearing blocks 44 which journal a shaft 46 having a plurality of elongated flails 48 pivotally secured thereto to project generally radially outwardly therefrom. The flails 48 are shown grouped in four equiangularly spaced groups with pivotal mountings at 50. The flails are preferably so configured that they can swing through an arc of about 60 degrees relative to their mounts 50, before they are stopped by abutment at 62. Beyond one bearing block 44, the shaft 46 has a pulley 64 secured thereon.

An endless drive belt 66 entrained about the pulley 64 and e.g. about the similar pulley (not shown) on the output shaft of an electric motor (not shown) provides rotary power for the shaft 46. Preferably, the shaft 46 is turned at about 2000–4000 rpm.

A control panel 68 mounted on the frame 12 and electrically connected to the vibrator 22 and to the electric motor of the pulverizer provides a convenient central location for varying the amplitude and/or frequency of vibration provided by the vibrator 22 and for operating the motor to rotate the flail shaft of the pulverizer.

By preference, the tubular inlet 26 is generally horizontal and joins the housing upper portion 34 tangentially thereof. A tubular outlet 70 proceeds generally radially outwardly and vertically downwardly from the housing lower portion 32, and into a pulverized product storage container 72. A plurality of longitudinally elongated, angularly spaced raised ribs 74 are shown formed on the inside of the outer peripheral wall 76 of the housing upper portion 34. The end walls 77 of the housing portion 34 are relieved at 78 to fit over the shaft 46 without binding. Packing and baffles 80 may be provided in and near these reliefs to prevent dust leakage from the housing.

The housing 28 is united by securing the flanges 36 and 40 together in confronting relation, with the halves 32 and 34 in complementary relation. Bolts 82 may provide the securement. When nothing is interposed between the flanges 36 and 38, the interior of the housing is generally cylindrical and the outer tips 48 of the flails miss contacting the ribs 74 by a minimum distance, for instance 0.0001 inch.

Adjustment of the throughput and fineness of grinding provided by the pulverizer 30 is accomplished by interposition of bushings or gaskets 86 of elastomeric material between the flanges 36, 38. As more or thicker elastomeric material is interposed, the effective interior of the upper portion of the housing becomes more eccentric relative to the envelope of the movement of the flails. In general, the greater the interposed thickness, the greater the eccentricity and the larger the average particle size discharged from the pulverizer.

The feeder/pulverizer 10 will work with dust size inlet particles, up to ones ⅛ to ¼ inch across or larger. The pulverizer housing radius may be 3 inches to a foot or more. Fluent particulate material of many kinds may be processed. Examples include animal feed grain and dietary supplements, fertilizer, nut meats, nut shells, seeds, cereals and other food stuffs, pebbles, lumpy pulverable material and the like.

The interposition of elastomeric material between the flanges 36 and 40 is effected by unsecuring these flanges from one another, inserting the desired thickness of interposed material, and reconnecting the flanges 36 and 38 with the interposed material caught between them. Accordingly, a simple, inexpensive and easy-to-operate pulverizer is provided with a hands-off feeding device and a cheap and simple adjustment for discharged particle size.

It should now be apparent that the vibratory hopper-fed, flail-type pulverizer as described hereinabove, possesses each of the attributes set forth in the specficiation under the heading "Summary of the Invention" hereinbefore. Because the vibratory hopper-fed, flailtype pulverizer can be modified to some extent without departing from the principles of the invention as they have been outlined and explained in this specification, the present invention should be understood as encompassing all such modifications as are within the spirit and scope of the following claims.

What is claimed is:

1. A flail-type pulverizer, comprising:

(1) a shaft;

(2) bearing means journalling the shaft for rotation;

(3) a plurality of elongated flails pivotally secured to said shaft to project generally radially therefrom;

(4) wall means providing a housing enclosing said flails, and including two opposite end walls and an outer peripheral wall extending between these end walls, the outer peripheral wall bearing a plurality of internal protuberances against which particles being flung by said flails may impact in order to effect particle size reduction;

(5) said housing being provided in at least two angularly adjoining portions, one of which is removable from the other and this removable portion including an angularly substantial part of said outer peripheral wall including many of said protuberances;

(6) means for removably securing said two housing portions together with said protuberances radially adjacent said flails;

(7) at least one layer of bushing material removably received between said two housing portions, for spacing the two housing portions slightly apart, thereby effectively increasing the distance between the radially outer extents of the flails and said protuberances on the outer peripheral wall of the removable portion of the housing, compared to the distance therebetween should said layer be omitted or thinned;

(8) means defining an outlet from said housing; and (9) means defining an inlet to said housing, spaced angularly about the housing from said outlet of the housing.

2. The pulverizer of claim 1, wherein:

the housing inlet is a generally horizontal tubular member;

the housing removable portion is generally semi-cylindrical; and the housing inlet is provided upon and joins the housing removable portion tangentially.

3. A vibratory hopper-fed, flail-type pulverizer, comprising:

(a) a vibratory feeder, including:

(1) a storage hopper having an inlet and an outlet;

(2) a vibrator secured to the hopper and operable to vibrate the hopper in a sense to convey fluent material contained in the hopper from the inlet thereof toward and out through the outlet thereof; and (b) a flail-type pulverizer, including:

(1) a shaft;

(2) bearing means journalling the shaft for rotation;

(3) a plurality of elongated flails pivotally secured to said shaft to project generally radially therefrom;

(4) wall means providing a housing enclosing said flails, and including two opposite end walls and an outer peripheral wall extending between these end walls;

(5) said housing being provided in at least two portions, one of which is removable from the other and this removable portion including an angularly substantial part of said outer peripheral wall;

(6) means for removably securing said two housing portions together;

(7) at least one layer of bushing material removably received between said two housing portions, for spacing the two housing portions slightly apart, thereby effectively increasing the distance between the radially outer extents of the flails and the outer peripheral wall of the removable portion of the housing, compared to the distance therebetween should said layer be omitted or thinned;

(8) means defining an outlet from said housing; and (9) means defining an inlet to said housing, spaced angularly about the housing from said outlet of the housing;

(c) the outlet of said storage hopper being directly connected to the inlet of said housing, so that said vibrator effectively conveys fluent material contained in the hopper into the housing.

4. The pulverizer of claim 3, wherein:

the housing inlet is a generally horizontal tubular member;

the housing removable portion is generally semi-cylindrical; and the housing inlet is provided upon and joins the housing removable portion tangentially.

5. The pulverizer of claim 4, wherein:

the other of said two housing portions is also generally semi-cylindrical in shape;

each of the two housing portions having outwardly directed flange means thereon;

these flange means confronting one another and having said layer of bushing means interposed therebetween;

the means for removably securing said two housing portions together being constituted by means clamping said flange means together.

6. The pulverizer of claim 5, further including:

a frame;

resilient means mounting the storage hopper on the frame so that said vibrator can vibrate the hopper with respect to the frame; and means securing said other housing portion of the pulverizer to said frame.

* * * * *